US007661203B2

(12) United States Patent
Fumagalli

(10) Patent No.: US 7,661,203 B2
(45) **Date of Patent: *Feb. 16, 2010**

(54) BASKET FOR WASHING MACHINE, WASHER-DRYER, AND THE LIKE

(75) Inventor: Silvano Fumagalli, Monza (IT)

(73) Assignee: Candy S.p.A., Monza (Milan) (IT)

( * ) Notice: Subject to any disclaimer, the term of this patent is extended or adjusted under 35 U.S.C. 154(b) by 118 days.

This patent is subject to a terminal disclaimer.

(21) Appl. No.: 11/812,632

(22) Filed: Jun. 20, 2007

(65) Prior Publication Data

US 2008/0005925 A1 Jan. 10, 2008

(51) Int. Cl.
*F26B 11/00* (2006.01)

(52) U.S. Cl. ..... 34/596; 34/606; 264/318; 249/64; 68/142; 68/20

(58) Field of Classification Search ..... 34/596, 34/606; 264/318; 249/64; 68/142, 20
See application file for complete search history.

(56) References Cited

U.S. PATENT DOCUMENTS 1,410,230 A * 3/1922 Wagner ..... 34/138
1,588,622 A * 6/1926 Savoy ..... 68/142
1,655,514 A * 1/1928 Seifert ..... 34/601
1,766,310 A * 6/1930 Schaum ..... 210/146
1,985,485 A * 12/1934 Crane ..... 68/242
2,262,186 A * 11/1941 Lindberg ..... 34/607
2,296,262 A * 9/1942 Breckenridge et al. ..... 68/12.02
2,358,779 A * 9/1944 Tholl ..... 210/364
2,385,223 A * 9/1945 Moore ..... 34/599
2,523,305 A * 9/1950 Johnson ..... 68/53
2,540,955 A * 2/1951 Moore ..... 34/605
2,547,238 A * 4/1951 Tremblay ..... 34/603
2,574,251 A * 11/1951 Dinley ..... 68/12.08
2,574,798 A * 11/1951 Rasmussen ..... 68/4
2,592,597 A * 4/1952 Pengelly ..... 68/23.5
2,608,769 A * 9/1952 O'Neil ..... 34/131
2,617,203 A * 11/1952 Murray ..... 34/82
2,645,111 A * 7/1953 Fields ..... 68/23.6
2,648,142 A * 8/1953 Shapter ..... 34/82
2,681,513 A * 6/1954 Fowler ..... 34/82
2,691,883 A * 10/1954 Abrams ..... 68/26
2,695,162 A * 11/1954 Kauffman, II ..... 366/349
2,716,820 A * 9/1955 Bourner ..... 34/82
2,722,751 A * 11/1955 Weston ..... 34/82
2,737,729 A * 3/1956 Engel ..... 34/602

(Continued)

FOREIGN PATENT DOCUMENTS

EP 1 876 282 * 1/2008

*Primary Examiner*—Stephen M. Gravini
(74) *Attorney, Agent, or Firm*—Dickstein Shapiro LLP

(57) ABSTRACT

A loading basket (6) for a washing machine (1) comprises a rear wall (8), a front wall (9) opposite the rear wall (8) and a side wall (7) defining an inner space (10) of the basket, as well as one or more dragging blades (12) arranged on the side wall (7) and projecting to the inside of the basket. The side wall (7) comprises a drilling with a plurality of small through holes (13), which are arranged at the vertex of respective domes (14) projecting to the outside of the basket (6), as well as a plurality of rounded projections (18) in the shape of a spherical dome without through holes and projecting to the inside (10) of the basket (6).

12 Claims, 3 Drawing Sheets

U.S. PATENT DOCUMENTS 2,750,782 A * 6/1956 Hamell, Jr. ..... 68/140
2,798,304 A * 7/1957 Reiter ..... 34/91
2,798,306 A * 7/1957 Reiter ..... 34/609
2,802,283 A * 8/1957 Strike ..... 34/87
2,813,414 A * 11/1957 Johnston ..... 68/20
2,831,333 A * 4/1958 Smith ..... 68/131
2,855,698 A * 10/1958 Hutt ..... 34/108
2,880,521 A * 4/1959 Gray, Jr. ..... 34/75
2,899,816 A * 8/1959 Jacobson ..... 68/20
2,921,384 A * 1/1960 Smith ..... 34/75
2,930,215 A * 3/1960 Smith ..... 68/23.7
2,944,415 A * 7/1960 Smith et al. ..... 68/18 F
2,974,422 A * 3/1961 Hobbs ..... 34/58
2,974,515 A * 3/1961 Smith et al. ..... 68/131
2,976,998 A * 3/1961 Smith ..... 34/323
2,991,990 A * 7/1961 Mitter ..... 432/107
2,996,809 A * 8/1961 Shapter ..... 34/75
RE25,157 E * 4/1962 Burkland ..... 68/23.3
3,028,740 A * 4/1962 Sisulak ..... 68/12.18
3,084,531 A * 4/1963 Matheny ..... 68/210
3,198,903 A * 8/1965 Chafee, Jr. ..... 335/152
3,247,689 A * 4/1966 Wasemann ..... 68/23.3
3,280,604 A * 10/1966 Panker ..... 68/146
3,320,678 A * 5/1967 Berke ..... 34/82
3,333,346 A * 8/1967 Brucken ..... 34/131
3,352,130 A * 11/1967 Landwier ..... 68/18 F
3,357,109 A * 12/1967 Harvey ..... 34/91
3,429,056 A * 2/1969 Metzger ..... 34/601
3,555,701 A * 1/1971 Hubbard ..... 34/602
3,584,394 A * 6/1971 Grabek ..... 34/599
3,616,545 A * 11/1971 Jacobs ..... 34/599
3,624,919 A * 12/1971 Miller ..... 34/607
3,718,982 A * 3/1973 Deaton ..... 34/82
3,721,015 A * 3/1973 Sisler et al. ..... 34/601
3,811,202 A * 5/1974 Arendt ..... 34/599
3,824,705 A * 7/1974 Ives ..... 34/170
3,969,070 A * 7/1976 Thompson ..... 432/105
4,328,600 A * 5/1982 Bochan ..... 8/159
4,502,303 A * 3/1985 Wasemann ..... 68/23.2
4,507,080 A * 3/1985 Freze ..... 432/105
4,519,223 A * 5/1985 Wasemann ..... 68/23.5
4,677,760 A * 7/1987 St. Louis ..... 34/90
4,809,723 A * 3/1989 Meliconi ..... 134/159
4,817,297 A * 4/1989 Toma et al. ..... 34/595
4,817,298 A * 4/1989 Toma ..... 34/595
4,835,991 A * 6/1989 Knoop et al. ..... 68/12.19
4,977,479 A * 12/1990 Caroll ..... 361/220
5,044,178 A * 9/1991 Altnau, Sr. ..... 68/17 A
5,143,104 A * 9/1992 Iba et al. ..... 134/135
5,167,898 A * 12/1992 Luther ..... 264/328.1
5,191,668 A * 3/1993 Euler et al. ..... 8/158
5,219,370 A * 6/1993 Farrington et al. ..... 8/158
5,220,734 A * 6/1993 Carver ..... 34/600
5,233,718 A * 8/1993 Hardaway et al. ..... 8/158
5,249,441 A * 10/1993 Pastryk et al. ..... 68/23.4
5,271,251 A * 12/1993 Kovich et al. ..... 68/171
5,345,637 A * 9/1994 Pastryk et al. ..... 8/158
5,371,956 A * 12/1994 St. Louis ..... 34/599
5,388,298 A * 2/1995 Rutter et al. ..... 8/158
5,421,103 A * 6/1995 Wunderlich ..... 34/599
5,460,018 A * 10/1995 Werner et al. ..... 68/23.6
5,463,821 A * 11/1995 Gauer ..... 34/261
5,504,955 A * 4/1996 Mueller et al. ..... 8/158
5,507,053 A * 4/1996 Mueller et al. ..... 8/158
5,706,588 A * 1/1998 Dausch et al. ..... 34/327
5,833,654 A * 11/1998 Powers et al. ..... 604/93.01
6,032,821 A * 3/2000 Martin et al. ..... 220/565
6,115,863 A * 9/2000 Mason et al. ..... 8/159
6,324,771 B1 * 12/2001 McAllister et al. ..... 34/595
6,412,191 B1 * 7/2002 Moyls ..... 34/328
6,430,971 B1 * 8/2002 Kaylan et al. ..... 68/23.7
6,491,181 B1 * 12/2002 Martin et al. ..... 220/565
6,622,618 B1 * 9/2003 Glucksman et al. ..... 99/495
6,745,495 B1 * 6/2004 Riddle et al. ..... 34/497
6,751,888 B2 * 6/2004 Lueckenbach ..... 34/595
6,757,986 B2 * 7/2004 Miller et al. ..... 34/132
6,874,248 B2 * 4/2005 Hong et al. ..... 34/239
6,941,678 B2 * 9/2005 Park ..... 34/528
6,941,679 B1 * 9/2005 Harris et al. ..... 34/596
6,968,632 B2 * 11/2005 Guinibert et al. ..... 34/602
6,995,965 B2 * 2/2006 Hameed et al. ..... 361/91.1
7,024,795 B2 * 4/2006 Tadano et al. ..... 34/76
7,055,262 B2 * 6/2006 Goldberg et al. ..... 34/86
7,065,905 B2 * 6/2006 Guinibert et al. ..... 34/603
7,225,562 B2 * 6/2007 Guinibert et al. ..... 34/601
7,257,905 B2 * 8/2007 Guinibert et al. ..... 34/82
7,322,126 B2 * 1/2008 Beaulac ..... 34/554
7,395,612 B2 * 7/2008 Jeong et al. ..... 34/602
7,467,483 B2 * 12/2008 Guinibert et al. ..... 34/601
2003/0074932 A1 * 4/2003 No et al. ..... 68/58
2004/0060196 A1 * 4/2004 Lueckenbach ..... 34/595
2004/0098878 A1 * 5/2004 Park et al. ..... 34/595
2004/0123486 A1 * 7/2004 Hameed et al. ..... 34/595
2004/0134092 A1 * 7/2004 Hong et al. ..... 34/595
2004/0200093 A1 * 10/2004 Wunderlin et al. ..... 34/606
2004/0261288 A1 * 12/2004 Beyerle et al. ..... 34/602
2005/0005651 A1 * 1/2005 Kim et al. ..... 68/24
2005/0022565 A1 * 2/2005 Jung et al. ..... 68/24
2005/0044744 A1 * 3/2005 Tadano et al. ..... 34/596
2005/0076535 A1 * 4/2005 Guinibert et al. ..... 34/601
2005/0115104 A1 * 6/2005 Guinibert et al. ..... 34/601
2005/0126034 A1 * 6/2005 Jeong et al. ..... 34/602
2005/0235519 A1 * 10/2005 Chung ..... 34/607
2006/0196077 A1 * 9/2006 Choi ..... 34/602
2006/0265899 A1 * 11/2006 Renzo ..... 34/603
2007/0006477 A1 * 1/2007 Guinibert et al. ..... 34/85
2007/0186440 A1 * 8/2007 Guinibert et al. ..... 34/603
2007/0220776 A1 * 9/2007 Guinibert et al. ..... 34/603
2008/0005925 A1 * 1/2008 Fumagalli ..... 34/596
2008/0006065 A1 * 1/2008 Fumagalli ..... 68/235 R
2008/0022551 A1 * 1/2008 Banta et al. ..... 34/602
2008/0022552 A1 * 1/2008 Forget ..... 34/602
2009/0064534 A1 * 3/2009 LeClerc ..... 34/603
2009/0083991 A1 * 4/2009 Prajescu ..... 34/601
2009/0083992 A1 * 4/2009 Prajescu et al. ..... 34/601

* cited by examiner

BASKET FOR WASHING MACHINE, WASHER-DRYER, AND THE LIKE

FIELD OF INVENTION

The present invention relates to a basket for a washing machine, dryer, or washer-dryer.

BACKGROUND OF THE INVENTION

With particular reference to the known washing machines, the perforated basket, which is intended to accommodate the laundry to be washed, is pivotally arranged within a tank containing the lye. Due to the rotational movement of the basket, the laundry is agitated and caused to spin in the lye, and the lye is carried upwards by the rotating basket, from where it falls on the laundry which results to be completely immersed and soaked, such that the impurities are transferred to the washing and rinsing lye.

The basket usually consists of a rear wall by means of which the basket is secured within the washing machine, a front wall defining a loading opening through which it is possible to gain access to the interior of the basket and a side wall being generally cylindrical and perforated to allow the lye exchange between the tank and the interior of the basket. The side wall is usually formed from a steel sheet with two opposite longitudinal edges and two opposite transversal edges, which is folded about a longitudinal axis of the basket to form this cylinder and the transversal edges of which are connected to each other to keep the cylindrical shape, whereas the longitudinal edges are connected to respective outer edges of the rear and front walls to form the basket.

To increase the washing and drying performance on the laundry contained within the basket, attempts are made to operate baskets in washing machines with increasing rotation speeds and increasingly abrupt reversals of the direction of rotation. These operating conditions of modern washing machines and dryers entail high centrifugal forces, which cause a part of the laundry to slip along the side wall of the basket without being agitated, and to be held within the recesses formed between the side wall of the basket and the dragging blades that radially project from this side wall towards the inside of the basket.

This "stagnant" accumulation of laundry along the outer wall of the basket, besides reducing the washing effectiveness on this part of the laundry, also obstructs the lye-exchange perforations between the washing tank and the basket.

The object of the present invention is thus to provide a basket for washing machines, washer-dryers and dryers having such characteristics as to cause a remixing of the laundry layer being formed along the side wall of the basket due to the centrifugal force, while allowing an improved exchange of liquid between the washing tank and the basket.

BRIEF DESCRIPTION OF THE INVENTION

This and other objects are achieved by means of a loading basket for a washing machine, washer-dryer, dryer, and the like, comprising:

- a rear wall to be secured to a support structure of the basket;
- a front wall opposite the rear wall,
- a side wall extending about a longitudinal axis being the axis of rotation of the basket, and which is connected to the rear and front walls to define an inner space of the basket,
- one or more dragging blades arranged on the side wall and projecting to the inside of the basket, in which the side wall comprises a perforation with a plurality of small through holes, which are arranged at the vertex of respective domes projecting towards the outside of the basket, as well as a plurality of rounded projections shaped as a spherical dome without through holes, and projecting towards the inside of the basket.

These rounded projections shaped as a spherical dome exert a "soft" dragging effect on the laundry being in contact with the side wall of the basket. The laundry does not slip any longer in snug contact along the side wall, but the rounded projections slightly lift the laundry against the centrifugal force, thus clearing the small through holes in the side wall and allowing remixing the laundry. The laundry, thus lifted, cannot build up within the recess between the side wall of the basket and the dragging blades, but rather hits the dragging blades in a farther area of the side wall of the basket, such that the blade deflects the movement of the laundry towards the inside of the basket. The lifting of the laundry is further supported by the absence of through holes in the rounded projections, and thus, by the absence of a radial stream of liquid in this restrained areas.

Advantageous embodiments of the present invention are the object of the dependent claims.

BRIEF DESCRIPTION OF THE FIGURES

The characteristics and advantages of the present invention will be better appreciated from the detailed description below of several embodiments thereof, which are provided by way of non-limiting examples and illustrated in the annexed drawings, in which.

DETAILED DESCRIPTION OF EMBODIMENTS

Figure 1:
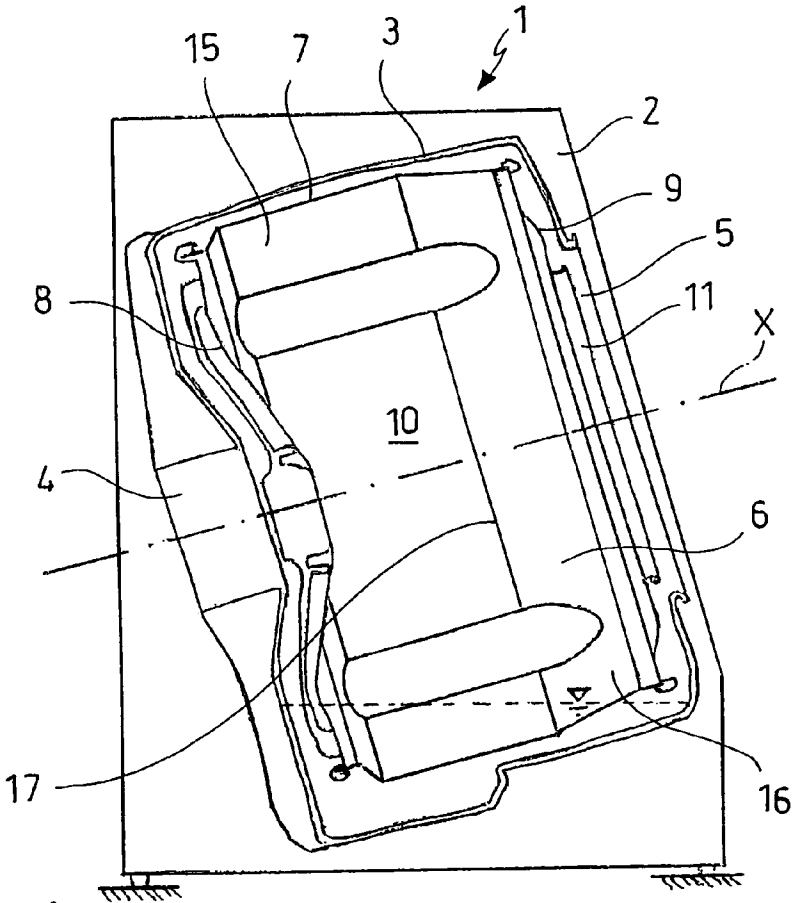
FIG. 1 is a schematic sectional view, according to a vertical middle plane, of a washing machine provided with a basket according to an embodiment of the invention.
Figure 2:
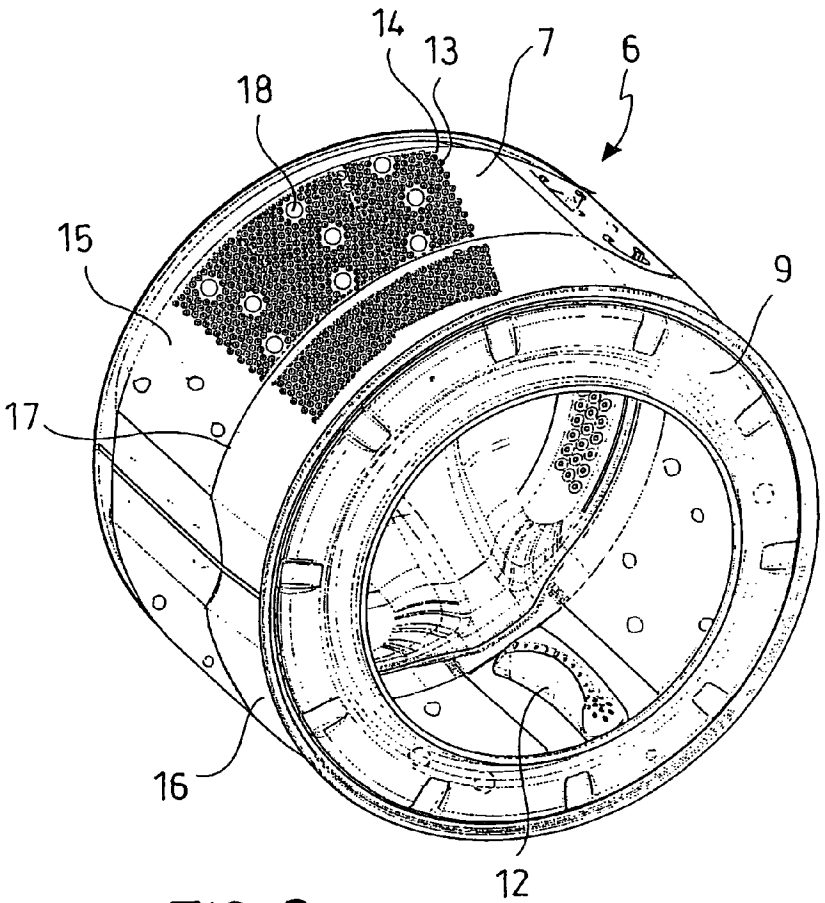
FIG. 2 is an isometric view of the basket in FIG. 1.

With reference to the figures, a front-loading washing machine with a biased-axis tank is schematically shown in FIG. 1. Particularly, the washing machine, which is generally designated with 1, comprises a cabinet 2, a tank 3 being housed therein, which consists of a generally cylindrical body, either made of plastic or stainless steel, with either biased or horizontal longitudinal axis X (as shown in FIG. 1). The tank 3 is coupled to the cabinet 2 by means of known means, which comprise shock absorbers and suspension springs, which are not shown in order to avoid burdening the drawing.

The tank 3 is provided with a front aperture 5, having a generally round shape, which can be closed by means of a porthole being frontally hinged to the cabinet 2 and not shown, as known per se. Within the tank 3, a basket 6 is housed rotatably about the axis X, for the laundry to be accommodated therein to be washed and/or dried. The basket 6 comprises a side wall 7, a rear or bottom wall 8 and a front wall 9. The walls 7, 8 and 9 define an inner space 10 intended to accommodate the laundry to be washed and/or dried. The front wall 9 of the basket 6 is a stainless steel or plastic ring, with an aperture 11 having a generally round shape, which is placed such as to match the aperture 5 of the tank 3 to provide access to the inner space 10 to load/unload the laundry.

The rear or bottom wall 8 of the basket 6 is preferably a substantially plane, centrally drawn, steel disk, being concave towards the outside of the basket. In the middle of the rear wall 8 of the basket 6, there is mounted a support hub 4 for the basket, the basket being operatively connected therethrough to motor means (not shown), which control the rotation of the same about the longitudinal axis X.

The side wall 7 of the basket is preferably obtained from a generally flat steel sheet, which is folded such as to form an approximatively rotational surface about a longitudinal central axis, being coincident with the longitudinal axis X of the tank 3 when in use.

The coupling of the bottom 8 and front 9 walls to the side wall 7 is preferably provided by folding two end tracts of the sheet being the side wall 7, such as to give a C-shaped profile to the steel plate at both ends thereof. The bottom 8 and front 9 walls are shaped such as to define, at the outer edges thereof, profiles matching the C-shaped profile that is formed at both end tracts of the side wall 7.

The basket 6 further comprises one or more, preferably three, dragging blades 12 that are arranged on the side wall 7 at 120° angular pitch and projecting towards the inside 10 of the basket.

The side wall 7 of the basket is provided with a perforation that provides, in the side wall, a pattern of a number of small through holes 13 that are substantially equidistant from each other and suitable to allow the lye to flow from the tank to the basket, and vice versa. Each of these small holes 13 is advantageously formed at the central vertex a dome 14 thereof, which is preferably formed by indentation, projecting to the outside of the basket. Due to the regular pattern of dome-shaped indentations 14 having 2 to 8 mm diameter, preferably 3 to 5 mm, and radially projecting to the outside of the basket, the drilled side wall 7 has a high rigidity and the edges of the small holes 13 result to be moved away from the laundry, such as to avoid an abrasive contact between the through holes 13 and the laundry.

The drilling is preferably only provided on a main cylindrical band 15 and a front band 16 having the shape of a truncated cone of the side wall 7, which are separated from each other by a circumferential bending line 17.

Particularly advantageously, those areas immediately surrounding the bending line 17 between the main band 17 and the front band 18 is preferably not provided with perforations 13 such that relative folds are more easily carried out along continuous lines.

In accordance with the invention, the side wall 7, and particularly the main cylindrical band 15 comprises a plurality of rounded projections 18, which protrude within the basket. These rounded projections 18 are not provided with small through holes and preferably have a diameter that is much greater that that of the small through holes 13 and domes 14 thereof. Preferably, the rounded projections are also dome-, or cap-shaped (convex as seen from the inside of the basket), which is preferably formed by means of indentation. These rounded projections 18 have an outer diameter ranging between 10 mm and 30 mm, preferably about 20 mm, and a height ranging between about 1 mm and 4 mm, preferably 2 mm, and exert a dragging and "soft" lifting effect on the laundry in contact with the side wall 7 of the basket 6.

Advantageously, the ratio of the outer diameter of the rounded projections (18) to the outer diameter of the domes (14) ranges between 2:1 and 4:1.

Experimental tests have shown that a particular arrangement of the rounded projections 18 unusually contributes to an improved washing effectiveness, particularly on delicate garments. This arrangement of the rounded projections 18 is shown in FIGS. 3A, 3B and 3C and provides for a circumferential sequence of individual groups of rounded projections 18 (in which each group advantageously comprises three projections 18) which define, in turn, an arrow-tip pattern, i.e. a triangular arrangement with the triangle vertex being oriented in the circumferential direction of the side wall 7.

Advantageously, four of said groups of rounded projections 18 are formed between two of the three dragging blades 12.

Figure 3A:
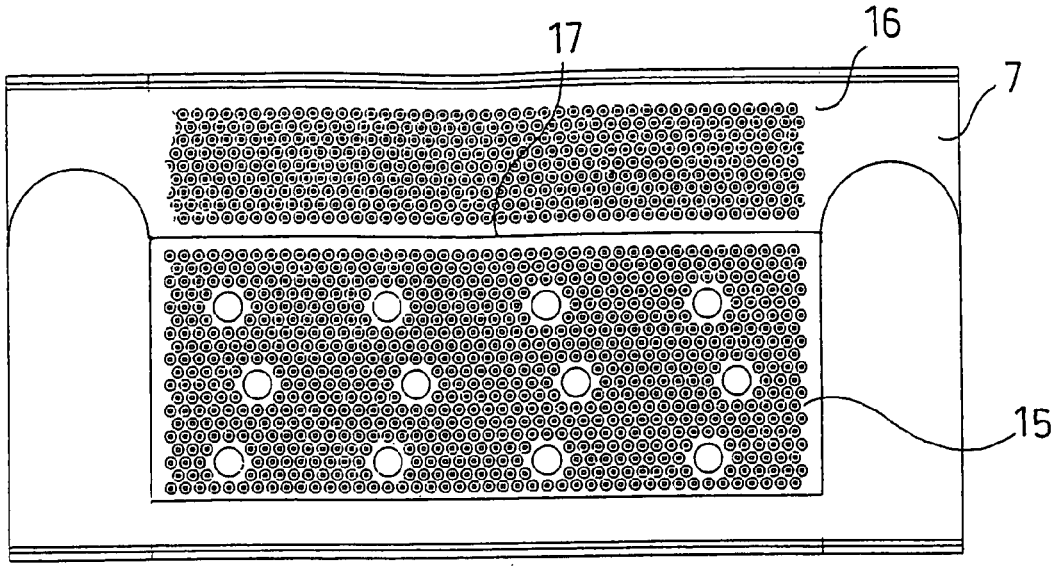
FIG. 3A, 3B, 3C are partial views of the side wall of the basket according to an embodiment of the invention as developed in a hypothetical development plane.
Figure 3B:
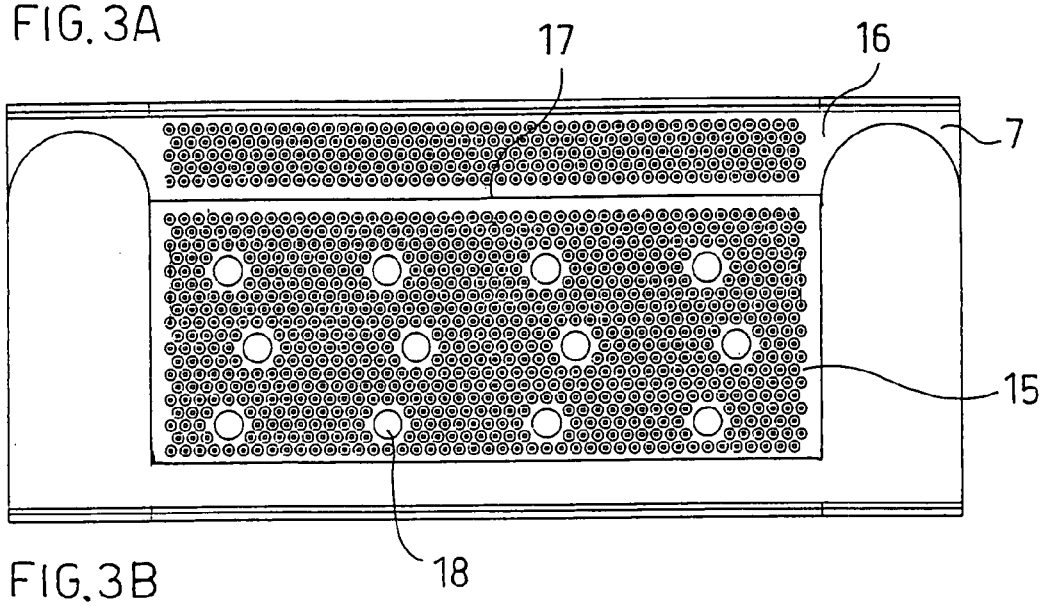
Figure 3C:
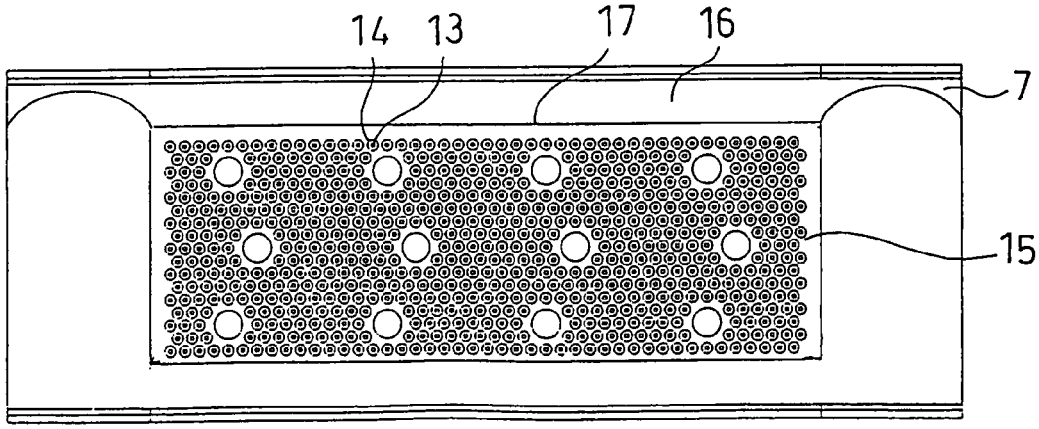
Figure 4:
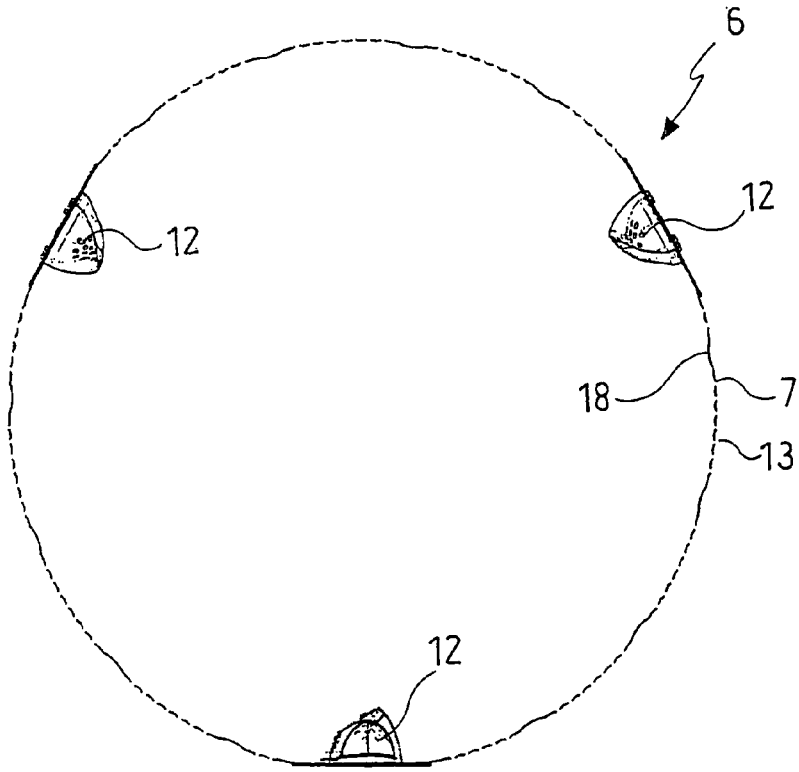
FIG. 4 is a cross-sectional view of the side wall of a basket according to an embodiment of the invention.
Figure 5:
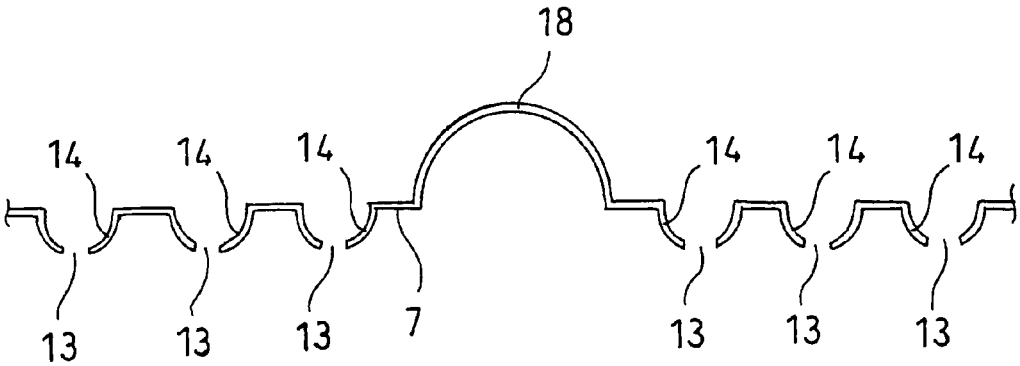
FIG. 5 is an enlarged cross-sectional view of a part of the side wall, in which the height of the rounded projections and domes with through holes has been represented on an enlarged scale.

FIGS. 3A, 3B and 3C show parts of the side wall 7 of baskets having different depths (or, in other words, longitudinal extensions), wherein the main cylindrical band 15 preferably has the same longitudinal extension, whereas the longitudinal extension of the front band 16 having the shape of a truncated cone changes according to the total depth of the basket. In the case of FIG. 3C, this front band 16 is very shallow and not provided with drilling.

From the detailed description of the invention provided above, those skilled in the art may appreciate how the combination of the individual characteristics can conciliate in a synergic manner the various requirements occurring in relation with the use of large-volume baskets in high-performing washing machines and dryers, particularly with a high number of revolutions.

The particular pattern of the through holes 13 of the side wall 7, and particularly the rounded projections 18 facing the inside of the basket allow carrying out a very strong washing also on delicate garments, without the risk of damage due to excessive friction between the laundry and the side wall of the basket.

It is understood that variants and/or additions can be provided, which will be readily within the capability of those skilled in the art, without however departing from the scope of protection as defined in the annexed claims.

What is claimed is:

1. A loading basket (6) for a washing machine (1), washer-dryer, dryer and the like, comprising:

a rear wall (8) to be secured to a support structure (4) of the basket;

a front wall (9) opposite the rear wall (8), a side wall (7) extending about a longitudinal axis (X), which is the axis of rotation of the basket and is connected to the rear (8) and front (9) walls to define an inner space (10) of the basket, one or more dragging blades (12) being arranged on the side wall (7) and projecting to the inside of the basket, wherein the side wall (7) comprises a perforation with a plurality of small through holes (13), which are arranged at the vertex of respective domes (14) projecting to the outside of the basket (6), as well as a plurality of rounded projections (18) in the shape of a spherical dome without through holes and projecting to the inside (10) of the basket (6); and wherein the rounded projections (18) have an outer diameter which is larger than the outer diameter of the small through holes (13) and the domes (14) thereof.

2. The loading basket (6) according to claim 1, wherein the ratio of the outer diameter of the rounded projections (18) to the outer diameter of the domes (14) ranges between 2:1 and 4:1.

3. The loading basket (6) according to claim 1, wherein the outer diameter of the rounded projections (18) is between 10 mm and 30 mm, and wherein the radial height of the rounded projections (18) is between 1 mm and 4 mm.

4. The loading basket (6) according to claim 1, comprising a circumferential sequence of individual groups of rounded projections (18) which define an arrow-tip pattern.

5. The loading basket (6) according to claim 4, wherein each group of rounded projections comprises three rounded projections (18) that are arranged to form a triangle with the vertex of the triangle being oriented in the circumferential direction of the side wall 7.

6. The loading basket (6) according to claim 1, comprising three dragging blades (12) being arranged at 120° angular pitch, wherein four of said groups of rounded projections (18) are formed between two dragging blades (12), respectively.

7. The basket (6) according to claim 1, wherein the through holes (13) are substantially equidistant from each other, and the domes (14) have a diameter ranging between 2 and 8 mm.

8. The loading basket (6) according to claim 1, wherein the side wall (7) of the basket is divided in two or more cylindrically-(15), and/or truncated cone-(16) shaped bands, by means of circumferential bending lines (17), said folding lines (17) and the immediately adjacent areas being not provided with drillings and rounded projections.

9. A washing machine (1), washer-dryer, dryer and the like, including a basket (6), said basket (6) comprising:

a rear wall (8) to be secured to a support structure (4) of the basket;

a front wall (9) opposite the rear wall (8), a side wall (7) extending about a longitudinal axis (X), which is the axis of rotation of the basket and is connected to the rear (8) and front (9) walls to define an inner space (10) of the basket, one or more dragging blades (12) being arranged on the side wall (7) and projecting to the inside of the basket, wherein the side wall (7) comprises a perforation with a plurality of small through holes (13), which are arranged at the vertex of respective domes (14) projecting to the outside of the basket (6), as well as a plurality of rounded projections (18) in the shape of a spherical dome without through holes and projecting to the inside (10) of the basket (6); and wherein the rounded projections (18) have an outer diameter which is 1arger than the outer diameter of the small through holes (13) and the domes (14) thereof.

10. The loading basket (6) according to claim 1, wherein the outer diameter of the rounded projections (18) is 20 mm.

11. The loading basket (6) according to claim 1, wherein the radial height of the rounded projections (18) is 2 mm.

12. The basket (6) according to claim 1, wherein the through holes (13) are substantially equidistant from each other, and the domes (14) have a diameter ranging from 3 mm to 5 mm.

* * * * *